United States Patent [19]

Long et al.

[11] 3,995,358

[45] Dec. 7, 1976

[54] APPLICATOR TOOL FOR MULTI-CONDUCTOR CONNECTOR

[75] Inventors: Robert Alvin Long; William Roderick Over, both of Harrisburg; Willard Allen Smith, Elizabethtown, all of Pa.

[73] Assignee: AMP Incorporated, Harrisburg, Pa.

[22] Filed: Feb. 10, 1976

[21] Appl. No.: 657,015

[52] U.S. Cl. ..... 29/203 MW; 29/203 P

[51] Int. Cl.[2] ..... H01R 43/04

[58] Field of Search ... 29/203 D, 203 HT, 203 MW, 29/203 P; 140/113

[56] References Cited

UNITED STATES PATENTS

| | | | |
|---|---|---|---|
| 3,758,935 | 9/1973 | Long et al. | 29/203 MW |
| 3,766,622 | 10/1973 | Brehm et al. | 29/203 MW |
| 3,800,390 | 4/1974 | Johnston | 29/203 P |
| 3,866,292 | 2/1975 | Tucci | 29/203 MW |
| 3,866,293 | 2/1975 | Nijman | 29/203 MW |
| 3,866,295 | 2/1975 | Tucci | 29/203 MW |
| 3,886,641 | 6/1975 | Davis | 29/203 MW |
| 3,935,628 | 2/1976 | Tucci | 29/203 MW |

*Primary Examiner*—C.W. Lanham
*Assistant Examiner*—E. M. Combs
*Attorney, Agent, or Firm*—R. W. Pitts; F. W. Raring; Jay L. Seitchik

[57] ABSTRACT

A semiautomatic apparatus for attaching the ends of insulated electrical wires to a multi-contact electrical connector is disclosed. The connector has two parallel rows of slotted terminals with wire receiving portions facing in opposite directions. The apparatus has two reciprocal inserters for simultaneously inserting a pair of wires into oppositely facing terminals. The apparatus also has rotatable flipper members which are actuated by the inserters and which precisely position the wires in alignment with the inserters.

16 Claims, 10 Drawing Figures

Fig. 1
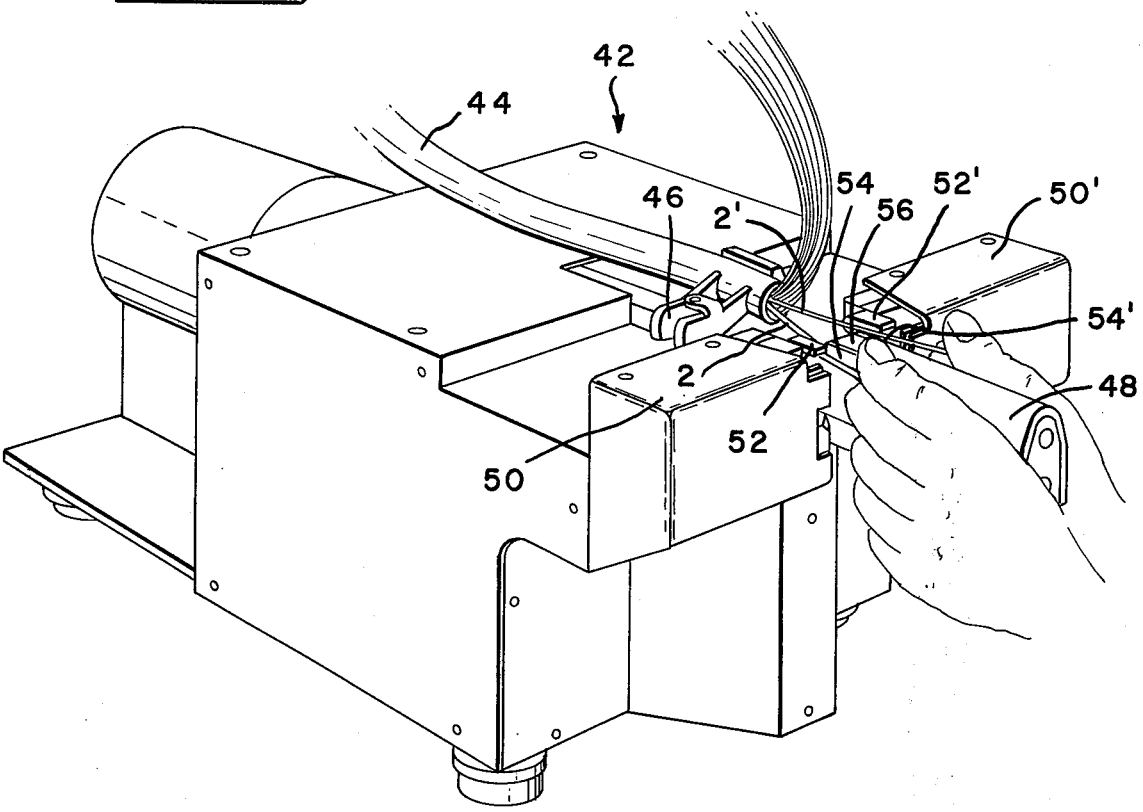
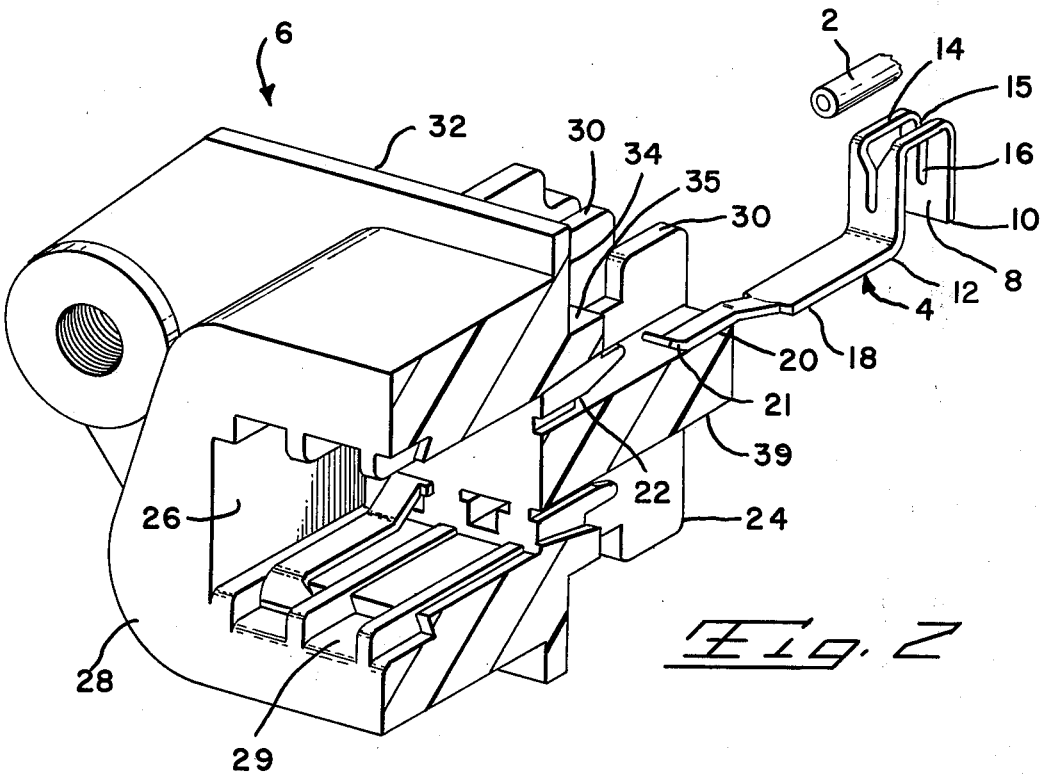
Fig. 2

APPLICATOR TOOL FOR MULTI-CONDUCTOR CONNECTOR

BACKGROUND OF THE INVENTION

1. Field of the Invention

This invention relates to the handling of electrical wires and their insertion into the wire-receiving portion of an electrical terminal. Normally the apparatus which embodies this invention is used with multi-contact connectors containing two rows of terminals with outwardly facing wire-receiving portions. Such connectors are commonly attached to multi-conductor telephone cables.

2. Description of the Prior Art

Apparatus emboding this invention can be used to attach wires to connectors such as that disclosed and claimed in U.S. Pat. No. 3,760,335. Such apparatus can also be used with numerous similar connectors. The instant invention comprises a modification of that disclosed and claimed in U.S. Pat. No. 3,766,622. That apparatus employed a centrally located connector carriage. Two reciprocal inserters attached wires to terminals located in a connector positioned on this carriage. The carriage indexed the connector past the inserters so that all of the terminals were sequentially aligned with the inserters. A cable containing a plurality of wires was positioned above the carriage. A pair of wires could be selected from this cable and one wire could be placed on each side of the connector in line with the appropriate inserter. The operator then brought the wires into contact with precisely positioned switches located below and on each side of the carriage. When the wires contacted these switches, the wires are under tension and proper alignment of the wire, inserter and terminal wire-receiving portion was assured. The inserters could then insert the wire into the terminal. A movable shearing edge on the inserter engaged a fixed shearing edge to sever each wire between the terminal and the switch.

SUMMARY OF THE INVENTION

The basic reciprocal inserter action described above is suitable for attaching wires to a variety of similar electrical connectors. This apparatus is especially useful where insulated wires are inserted into slotted terminals which penetrate the insulation and contact the underlying wire. The wire-receiving portions of similar electrical connectors are not identical however. Varying wire insertion dimensions can render a given tool useless for attaching wires to a particular connector. By utilizing the instant invention it is possible to precisely align the centerline of the wire with the center of the terminal wire-receiving cavity. This alignment is accomplished by trapping the wire between parallel walls. An inserter can then move the wire between these walls and into the terminal wire-receiving portion. A narrow inserter which can be used with any terminal can then be employed. With the original apparatus, the wires had no side support and the inserter had to be wide enough to prevent the wire from slipping off the inserter head.

By using parallel walls to properly align the wires, the presence of precisely aligned switches below the carriage is no longer necessary. This invention employs switch and actuating means which are triggered by a force exerted by lateral movement of the wires. This force is exerted against the switch and actuating means at an elevation above or adjacent to the inserters. This provision leads to the use of shorter wires and less scrap wire.

This invention employs rotating flipper members which bend each wire so that its local axis is vertical and precisely aligned between the inserter and terminal wire-receiving portion. The lower surface of these flippers comprise one of the parallel walls used to precisely align the wires. By utilizing these rotatable flippers it is not necessary to have the operator bend and dress the wires past and below the connector. The operator need only extend a wire on either side of the connector and below the flippers. Movement of the wires away from the connector will trigger inward movement of the reciprocal inserters. As the inserters move inwardly the flippers are cammed into position and the wires are bent. The inserters then move the wires laterally of their axis and into the terminal wire-receiving portions. The consequent reduction in operator movement should lead to a simplier and possibly speedier operation in addition to the reduction in scrap wire, and the broader range of utilization for the tool.

BRIEF DESCRIPTION OF THE DRAWINGS

FIG. 1 is a perspective view of the apparatus showing the initial positioning of the wires by the operator.

FIG. 2 is a cutaway perspective view of a connector which can be terminated by this apparatus.

DETAILED DESCRIPTION OF THE INVENTION

Figure 3:
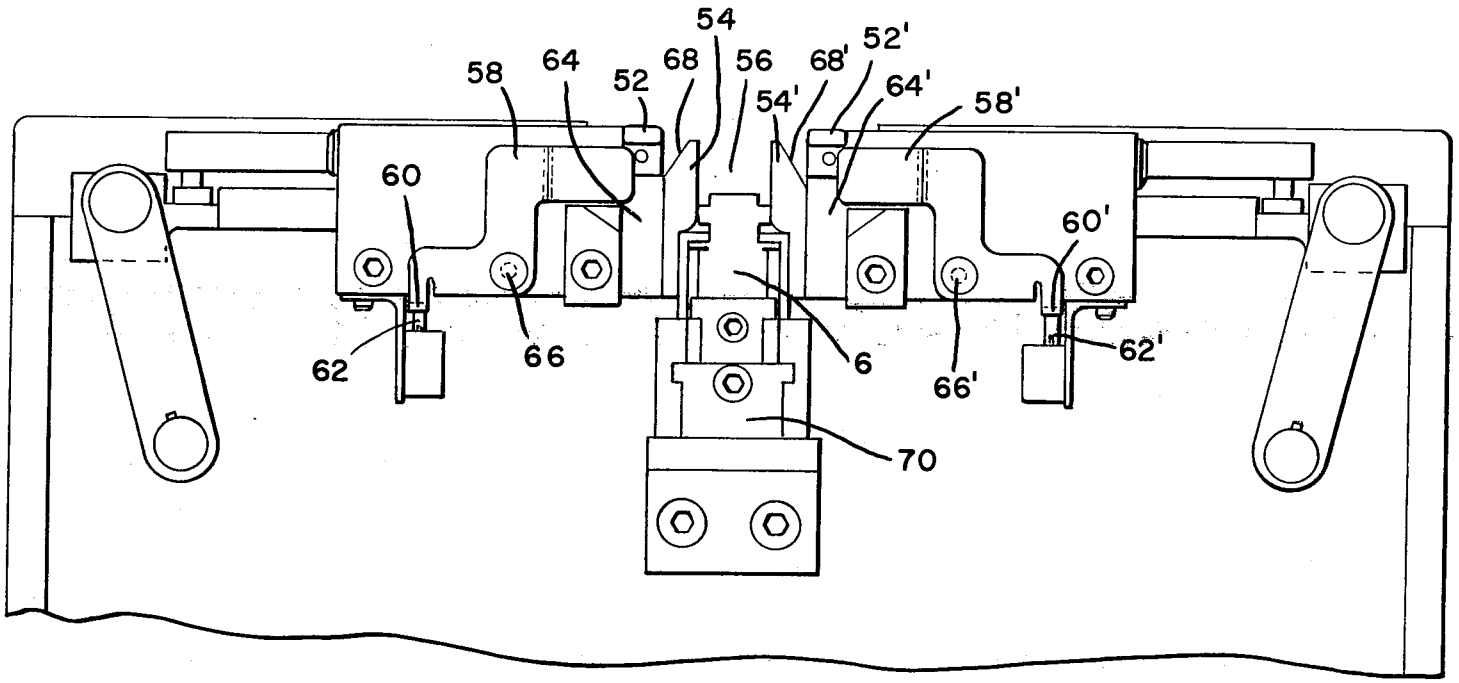
FIG. 3 is a frontal view showing the insertion ram means, switches, flippers and a connector.

The herein disclosed embodiment of the invention is intended for use in inserting wires into the terminal receiving portion 8 of each one of a plurality of electrical terminals 4 contained in an electrical connector 6. Connectors and terminals as disclosed in FIG. 2 are fully described in U.S. Pat. No. 3,760,335, however, some structural features of the connector and the terminal must be described here for an understanding of the present invention. The wire receiving portion 8 of each terminal is generally U-shaped having spaced apart parallel plate-like sections 10, 12 which are connected by a bight section 14. A slot 15 extends through the bight 14 and into the plate-like sections at 16 so that when the wire is forced downwardly and to the slot, the edges of the slot will penetrate the insulation of the wire and establish electrical contact with the conducting core thereof.

The terminal 4 further comprises a flat shank 18 extending from plate section 12 and an offset contact portion 20 which has a laterally extending ear 21 on its end. A plurality of cavities 22 extend through the connector housing from the rearward side 24 thereof and open into a trough 26 in the forward or mating side 28 of the housing. These cavities and recesses 29 on the sides of the trough 26 are contoured to receive the terminals 4. The connectors shown are adapted to be mated with a complementary connector as disclosed in U.S. Pat. No. 3,760,335. Barriers 30 are provided on the connector housing adjacent to the rearward side 24 between adjacent cavities 22. It should also be noted that a flange 32 extends outwardly from the housing between the rearward and mating faces and a rearwardly facing surface 34 and ledge 35 are defined by the rearwardly facing side of this flange.

The apparatus which is the subject of this invention is an improved device which is very similar to the apparatus disclosed in and claimed in U.S. Pat. No. 3,766,622, which will be referred to as the original apparatus. The connector is positioned in the manner as disclosed in the above patent and the connector is indexed so that the wire-receiving portion of each connector can be positioned at loading station 56. Loading station 56 refers to the immediate area surrounding terminal wire-receiving portion 8 at the time of insertion of wires 2 into slots 15. Two inserters, 74 mounted on the end of insertion rams 72 move inwardly toward the loading station 56 in the same manner as in the original apparatus. Cable 44 is clamped above connector 6 and this wire holding means positions the cable parallel to the rows of terminals just as in the original apparatus. The operator grasps one wire in each hand and positions these wires on opposite sides of the loading zone. The wires are dressed on opposite sides of the connector in a new and different manner, however. The wires are dressed so that they cooperate with a new structural configuration which is illustrated in the accompanying figures.

The geometry of loading station 56 is different from that embodied in the original apparatus. The connector 6 is flanked by separators or wire guides 54 and 54' on either side of loading station 56. Separators 54 and 54' are generally rectangular with the longitudinal dimension, defining a first side, extending parallel to the terminal rows in connector 6. A second side is perpendicular to the terminal rows and is adjacent to the loading station. In this embodiment, separators 54 and 54' are stationary. A sloping surface 68 is located adjacent the top of each separator guide. This sloping surface 68 is on the opposite side of the separator guide from loading station 56. The rear surface 96 of separator guide 54 is adjacent to the path of inserter 74 and is also adjacent to the wire receiving portion of a terminal located in alignment with inserter 74. This positioning of separator guide 54 is shown from above in FIG. 9.

A member having a generally planar first surface 64 is located on the opposite side of the insertion path from the rear surface 96 of separator 54. This first planar surface 64 extends generally perpendicular to the longitudinal dimension of separator 54 and to the rows of wire-receiving terminals in connector 6. Surface 64 is generally parallel to and adjacent to the path traversed by inserter 74. The terminal shown in connector 6 has a wire-receiving portion comprising a slot 15. Precise alignment of a wire 2 and slot 16 is accomplished by appropriate positioning of first planar surface or wall 64, slot 15, and surface 84. Surface 64 is displaced from the centerline of slot 15 by a distance which will be equal to or greater than the radius of wire 2 and less than the diameter of wire 2. The top 65 of the conductor stop member is generally perpendicular to first surface 64. Top surface 65 is located generally between the elevation of the terminals 4 in connector 6 and the location of clamped cable 44.

Figure 4:
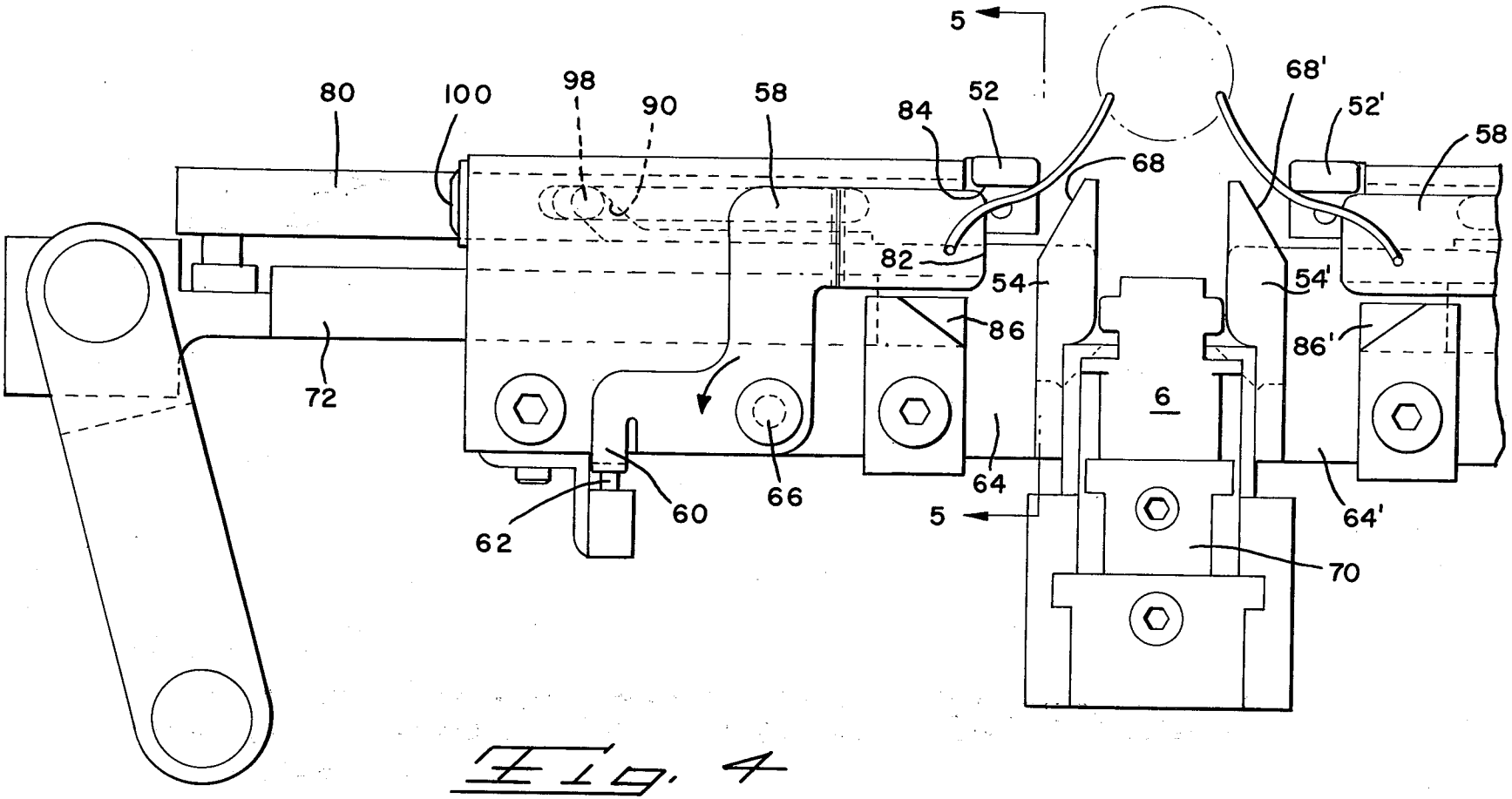
FIG. 4 shows the position of the cable and wires laced under the flippers.
Figure 5:
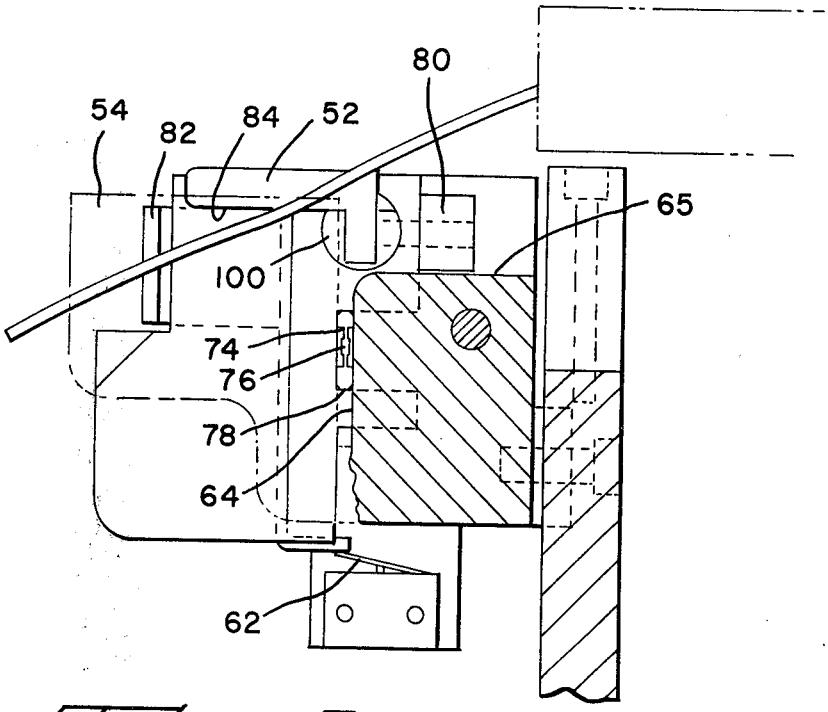
FIG. 5 is a sectional view showing the initial position of the wires and the initial orientation of the flipper.
Figure 6:
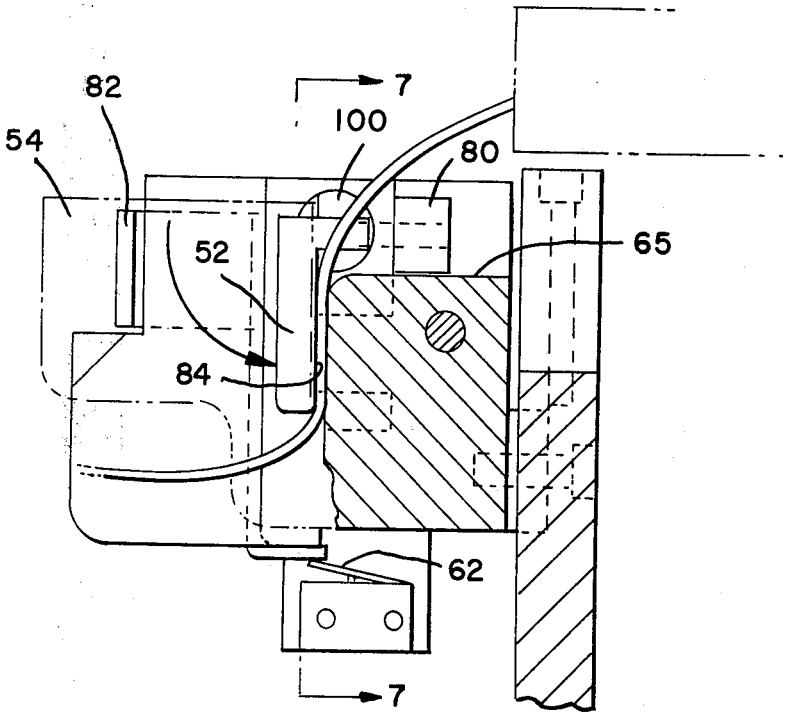
FIG. 6 shows the secondary orientation of the flipper after the wire has been bent.
Figure 7:
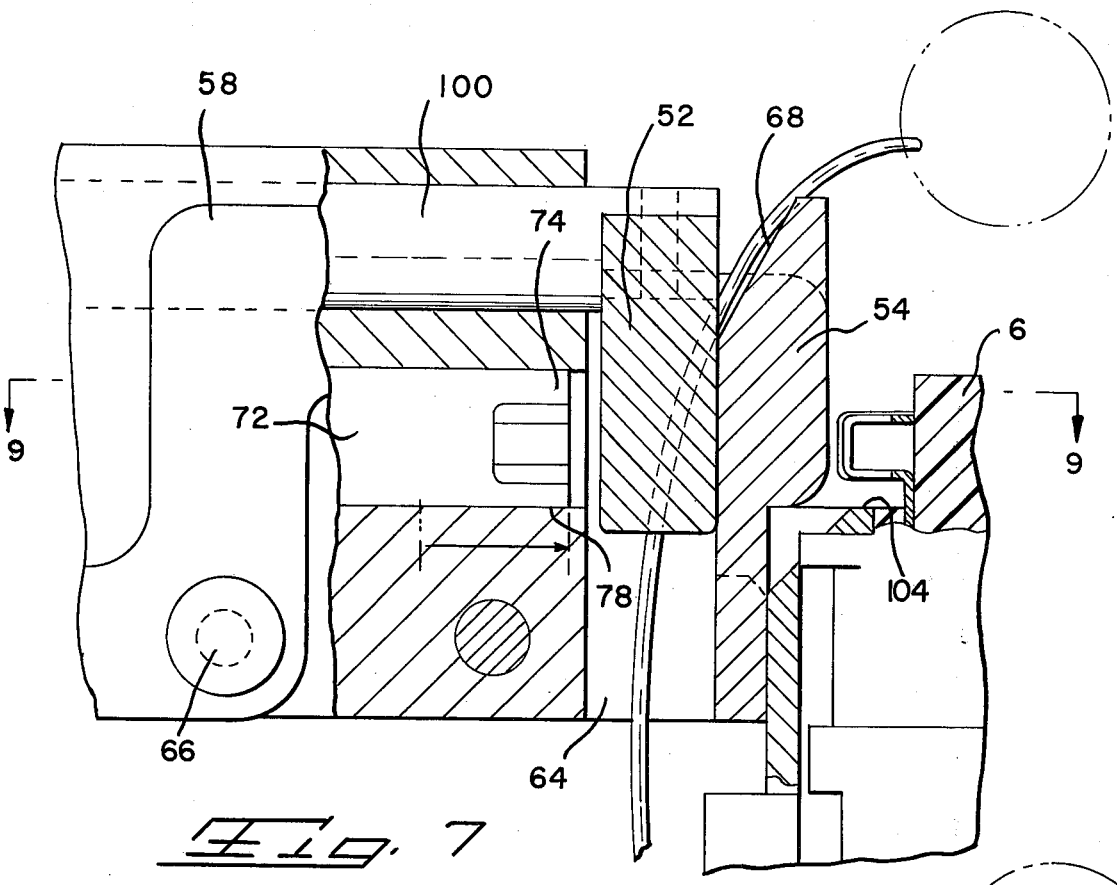
FIG. 7 is a front view of the loading station with the flipper in the position of FIG. 6, but prior to contact between the inserter and the wire.

Oblong flipper member 52 is located above top surface 65 and adjacent to separator wire guide 54. Separator wire guide 54 is closer to connector 6 than is flipper 52. Flipper 52 has a second planar surface 84. As shown in FIG. 4, this second surface 84 comprises the lower surface of flipper 52. There is a gap between surface 84 and sloping separator surface 68. Flipper 54 can be rotated from an initial orientation shown in FIG. 4 to a secondary orientation shown in FIGS. 6 through 10. When flipper 54 is in the secondary orientation, second planar surface 84 is parallel to the first planar surface 64. It can be seen from FIGS. 6–10 that first and second planar surfaces are spaced apart by a distance substantially equal to and greater than the diameter of the wire to be inserted into terminals 4.

The insertion ram 72 is similar to the insertion ram shown in the original apparatus which is the subject of U.S. Pat. No. 3,766,622. Ram 72 has an inserter 74 located at its forward end. The inserter 74 has a width which is less than the width of slots 15 in terminals 4. The inserter 74 has a central stuffer 76. The lower surface 78 of inserter 74 is perpendicular to the longitudinal dimension of inserter 74. The inserter travels along an insertion path towards and away from loading station 56. Inserters 74 travel from a remote to a fully extended position. In the latter position the inserter head is within loading station 56.

Figure 9:
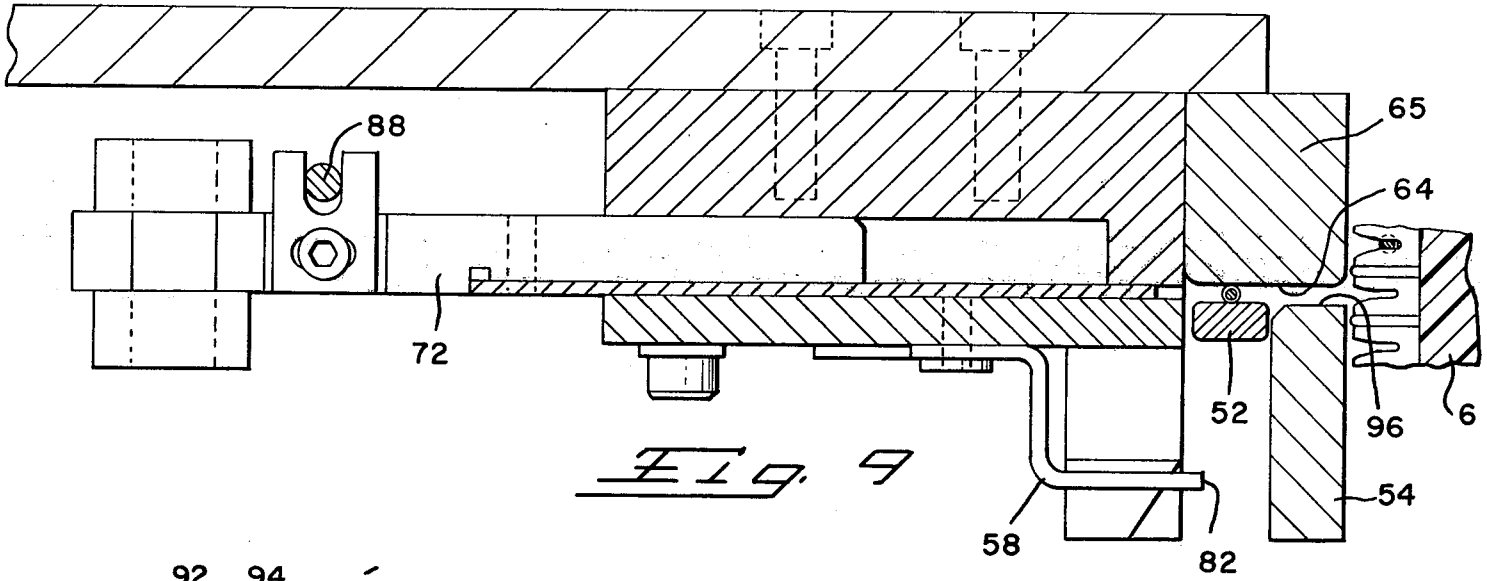
FIG. 9 is a top view showing the same positions as FIG. 7.
Figure 10:
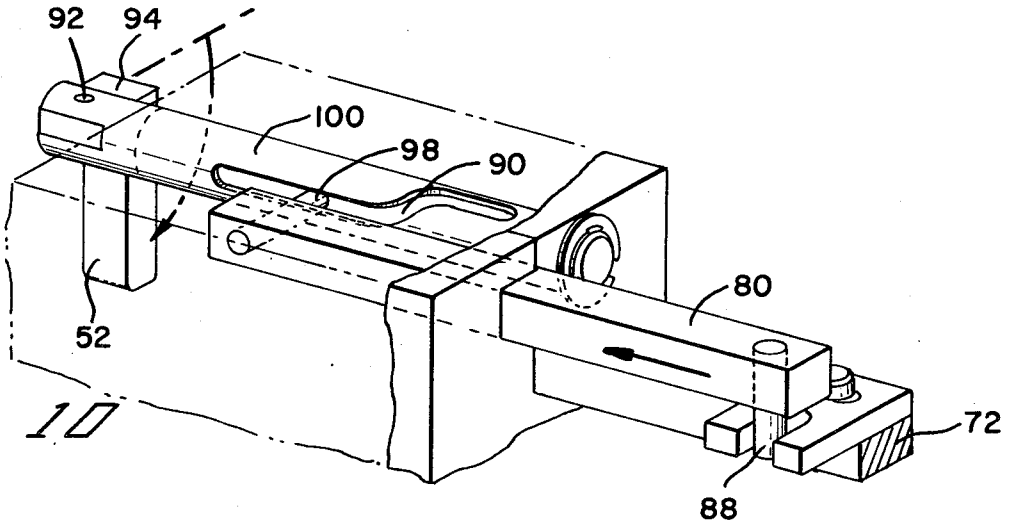
FIG. 10 shows the insertion ram, the flipper ram, and the fully rotated flipper.

FIGS. 9 and 10 illustrate the location of flipper ram 80. Flipper ram 80 is located above insertion ram 72. A drive pin 88 connects insertion ram 72 and flipper ram 80. Pin 98 is located on the other end, the left in FIG. 10, of flipper ram 80. One end of 98 is located in a cam track 90 on the surface of cylindrical shaft 100. Flipper 52 has a right angle extension 94 which is connected to one end of cylindrical shaft 100 by means of pin 92. In FIG. 10, cam track 90 is located on the right of shaft 100 while flipper 52 is attached to the left end. Travel of insertion ram 72 acting through flipper ram 80 and cam track 90 cause flipper 52 to rotate through an angle of substantially 90°. Note that the flipper rotates about an axis parallel to the insertion path. In one particular embodiment of this invention, complete rotation of flipper 52 is accomplished during the first quarter inch travel of insertion ram 72.

Movement of insertion ram 72 is triggered by activation of switch 62. A switch acting lever 58 is mounted parallel to the path of inserter 74. Switch acting lever 58 rotates around a pivot pin 66. A finger 60 is located on one end of lever 58. Finger 60 contacts switch 62. As viewed in FIG. 4, counterclockwise rotation of left switch actuating lever 58 causes finger 60 to trip switch 62. This counterclockwise rotation of left lever 58 is caused by the execution of a force against edge 82 to the lever as shown in FIG. 4. This force would then be directed away from loading station 56 and parallel to the path traveled by insertion ram 72.

OPERATION

The insertion apparatus which is the subject of the invention is used to sequentially insert pairs of wires into a multi-conductor connector. Each connector, as shown in the cut-away view of FIG. 2, has two parallel rows of equally spaced terminals 4. As with the original device shown in U.S. Pat. No. 3,760,335 the connector is moved relative to the path traversed by inserters 74. Wires placed between inserters 74 and terminals 4 will be moved laterally of their respective local axis into wire-receiving slots 15.

FIG. 1 shows an operator as he grasps two wires, one in each hand. The operator draws each wire toward him. He then brings the wires down, dressing them along the outwardly sloping surfaces 68 and 68' on separator guides 54 and 54'. One wire is now located on each side of connector 6. At this point, neither wire is in proper alignment with slots 15. The operator next moves each wire away from the centrally located connector. This last outward movement of the two wires brings each wire beneath the lower surface 84 of the appropriate flipper 52 or 52'. Note that during this outward movement of two wires, flippers 52 and 52' are in an initial orientation shown in FIGS. 1 and 4. Outward movement of the wires continues until each wire comes into contact with edge 82 on switch actuating lever 58 on the left and 58' on the right. A force is then exerted against the switch actuating lever which in turn triggers movement of insertion rams 72 and 72' as well as rotation of flippers 52 and 52'. Note that switches 62 and 62' are not actuated until the wires have moved well beneath flippers 52 and 52'. The operator's hand movement is now complete. The remaining positioning and insertion of the wires is accomplished by the action of flippers 52 and 52' and inserters 74 and 74'. Simplier and less hand movement is required using this technique as opposed to that used with the original device.

Figure 8:
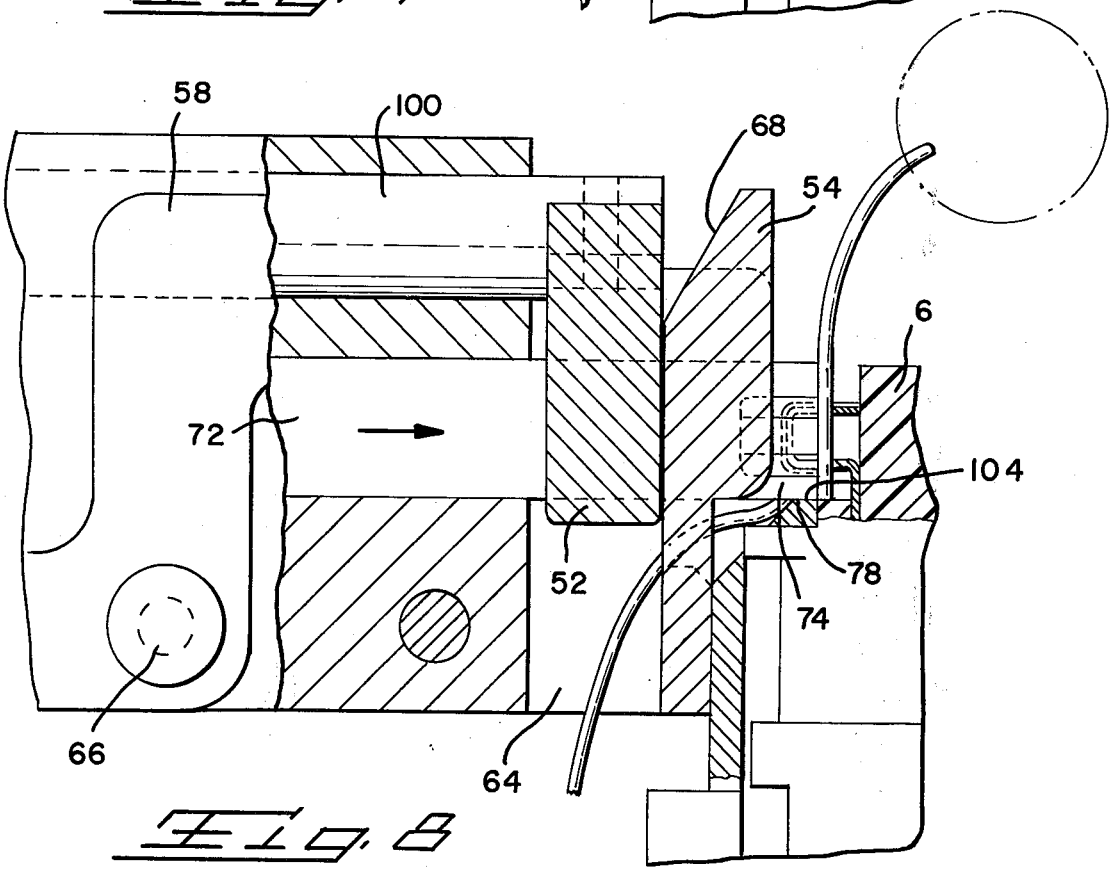
FIG. 8 shows the ultimate insertion of the wire into the terminal.

As in the original apparatus, insertion rams 72 and 72' move from the position represented by FIG. 4 to that shown in FIG. 8. Inserters 74 and 74' thus move from a remote to a fully extended position. This latter position is shown in FIG. 8. In addition to the movement of inserters 74 and 74', insertion rams 72 and 72' cause rotation of flippers 52 and 52'. FIG. 10 shows the rotating means and illustrates the use of cam track 90 which forms the basic interconnection between flipper 52 and insertion ram 72.

Rotation of flipper 52 is accomplished during the first portion of the travel of ram 72. Flipper rotation must be completed before movement of wire 2 by inserter 74. Prior to rotation of flipper 52, wire 2 is not even in alignment with inserter 74. As flipper 52 rotates, wire 2 which lies against the lower surface 84, bends so that its local axis is eventually vertical and in alignment with inserter 74. Flipper 52 thus acts as a wire camming means. While wire 2 is bent, the operator still holds the end of the wire. Wire 2 now is trapped between parallel surfaces 84 and 64 in alignment with inserter 74. Continued movement of inserter 74 moves wire 2 laterally of its local vertical axis between surfaces 64 and 84 and into slot 15. As the lower surface 78 of the inserter moves past stationary surface 104 wire 2 is severed as shown in FIG. 8. Indexing means then move the connector and align the next terminals at the loading station. The same steps are then repeated.

The embodiment illustrated in the accompanying figures completely illustrates the basic elements of this invention. Other embodiments differing in detail but not in substance would incorporate all of the elements of this invention. For example, an embodiment utilizing a stationary connector and movable insertion and flipper tooling would be an alternate embodiment of this same invention.

What is claimed is:

1. An apparatus for inserting wires into terminals located in a horizontally extending row by moving each of said wires laterally of its local axis into a wire receiving portion of one of said terminals, said apparatus comprising, a generally planar, vertically extending first surface, terminal positioning means for positioning said row of terminals transverse to said vertically extending surface, with one of said wire receiving portions in a predetermined position spaced from the plane of said first surface by a distance approximately equal to and greater than the radius of one of said wires, and less than the diameter of said one wire, a second generally planar surface, normally located in an initial orientation extending transverse to said first surface and above said row, and rotating means for rotating said second surface about an axis parallel to said first surface and transverse to said row from said initial orientation to a secondary orientation in which said second surface extends parallel to said first surface and is spaced from said first surface by a distance substantially equal to the diameter of one of said wires, whereby one of said wires may be placed between said initial orientation of said second surface and said first surface and subsequently said second surface can be rotated to precisely position said one wire between said first surface and said secondary orientation of said second surface with its local axis extending vertically and with said wire being in alignment with said wire receiving portion in said predetermined position and then said wire may be moved laterally of its local axis into said aligned wire receiving portion.

2. An apparatus as set forth in claim 1 comprising insertion means movable parallel to said first surface and between said first surface and said secondary orientation of said second surface, said insertion means being reciprocal between a remote position and a fully extended position, said fully extended position being adjacent to said predetermined position so that said one wire positioned between said first surface and said secondary orientation of said second surface and also between said remote and fully extended position of said insertion means will be inserted laterally of its local vertical axis into said wire receiving portion upon movement of said insertion means.

3. An apparatus as set forth in claim 2 comprising indexing means for moving said row of terminals relative to said first surface to sequentially position the wire-receiving portion of other terminals in said row in said predetermined position.

4. An apparatus as set forth in claim 3 comprising wire holding means for positioning a plurality of wires parallel to said row of terminals and generally above said row wherein each of said wires, when placed between said row and said initial orientation of said second surface, extend generally horizontal.

5. An apparatus as set forth in claim 4 wherein said insertion means comprises means for rotating said second surface from said initial orientation to said secondary orientation as said insertion means begins its movement from said remote position to said fully extended position, and prior to movement of said wire by said insertion means.

6. An apparatus as set forth in claim 5 comprising switch means for triggering movement of said insertion means toward said predetermined position, said switch means being activated by movement of said one wire away from said predetermined location along said initial orientation of said second surface.

7. An apparatus as set forth in claim 1 wherein said first surface is stationary and said indexing means moves said row of terminals sequentially past said first surface.

8. An apparatus for trimming and inserting electrical wires into the wire receiving portions of terminals located in a row in an electrical connector, said apparatus comprising:

a loading station and means for positioning said connector with the wire receiving portion of one terminal in said loading station, an inserter movable along an insertion path from a remote position to a fully extended position, said remote position being spaced from said loading station, and said fully extended position being within said loading station, a conductor stop located adjacent to said loading station and adjacent to said insertion path, wire camming means for bending a wire substantially through a right angle, said wire camming means being located adjacent to said loading zone, and spaced from said conductor stop, whereby a substantially straight wire can be positioned adjacent to said loading station, perpendicular to said insertion path, and between said wire camming means and said loading station and upon activation of said wire camming means said wire is bent and positioned between said inserter and said terminal and upon movement of said inserter, said wire is moved laterally of its axis into said wire receiving portion of said terminal.

9. An apparatus as set forth in claim 8 wherein said wire camming means comprises an oblong flipper member, said flipper member being rotatable between an orientation generally parallel to said row and an orientation generally perpendicular to said row.

10. An apparatus as set forth in claim 9 wherein said inserter is connected to said flipper member by means of a cam track so that said flipper member is rotated about an axis parallel to said insertion path by movement of said inserter from said remote position toward said fully extended position, rotation of said flipper member being complete before said inserter moves said wire laterally of its axis.

11. An apparatus as set forth in claim 8 wherein said conductor stop is stationary.

12. An apparatus as set forth in claim 8 wherein said conductor stop comprises a planar surface parallel to and adjacent to said insertion path.

13. An apparatus as set forth in claim 8 comprising two conductor stops and two inserters one of each located on each side of said loading station, said two inserters being movable towards and away from each other so that a pair of wires may be simultaneously inserted into two similarly located terminals in a connector having two parallel rows of terminals with oppositely facing wire receiving portions.

14. An apparatus as set forth in claim 13 comprising wire separator means located between said two inserters and on the opposite side of said insertion path from said conductor stops.

15. An apparatus as set forth in claim 13 comprising switch actuation means for triggering movement of said inserters, said switch actuation means being activated by a force exerted generally parallel to said insertion path and away from said loading zone.

16. An apparatus for sequentially inserting a series of wires individually into a plurality of contact terminals in a multi-contact electrical connector, said terminals having wire receiving portions of the type which establish contact with a wire upon movement of said wire laterally of its axis into said wire receiving portion, said apparatus including a loading station, carriage means for positioning said connector with said wire receiving portions in alignment with said loading station, and indexing means for moving said connector relative to said loading station and sequentially positioning each connector within said loading station, the improvement comprising:

an oblong flipper member rotatable about an axis of rotation, an inserter movable along an insertion path parallel to said axis of rotation, switch means for actuating said inserter and said flipper member upon exertion of a force generally parallel to said insertion path and away from said loading station, a conductor stop having a first planar surface parallel to said axis of rotation and parallel to said insertion path, a separator member adjacent to said loading station, said separator member having mutually perpendicular first and second sides, said first side being parallel to and spaced from said first planar surface on said conductor stop, flipper actuation means for rotating said flipper through an angle from an initial orientation past said second side of said separator member to a secondary orientation in which said flipper member is adjacent to said insertion path and parallel to and spaced from said first planar surface of said conductor stop so that said insertion path is bounded by said conductor stop, said flipper member and said separator member, whereby a wire may be positioned between said separator member, said switch means, and said initial orientation of said flipper member and upon rotation of said flipper member, said wire will be bent so that the local axis of said wire is between said flipper member in said secondary orientation and said conductor stop and between said inserter and said loading station whereupon movement of said inserter towards said loading station moves said wire laterally of its local axis along a portion of said insertion path and into said terminal wire receiving portion in said loading station.

* * * * *